US007021267B2

(12) United States Patent
Kawakubo et al.

(10) Patent No.: US 7,021,267 B2
(45) Date of Patent: Apr. 4, 2006

(54) MULTI-CYLINDER INTERNAL COMBUSTION ENGINE AND VEHICLE INCORPORATING SAME

(75) Inventors: Hiroyuki Kawakubo, Saitama (JP); Toru Gunji, Saitama (JP); Hiromi Sumi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 72 days.

(21) Appl. No.: 10/735,293

(22) Filed: Dec. 12, 2003

(65) Prior Publication Data

US 2004/0173176 A1 Sep. 9, 2004

(30) Foreign Application Priority Data

Dec. 25, 2002 (JP) ..... 2002-374831

(51) Int. Cl.
*F01M 5/00* (2006.01)

(52) U.S. Cl. ..... 123/196 R; 123/196 A; 123/196 AB

(58) Field of Classification Search ..... 123/192.2, 123/196 R, 196 A, 196 AB
See application file for complete search history.

(56) References Cited

U.S. PATENT DOCUMENTS

| | | | | |
|---|---|---|---|---|
| 3,667,317 | A | 6/1972 | Hillingrathner | |
| 4,074,670 | A | 2/1978 | Roberts et al. | |
| 4,158,346 | A | 6/1979 | Roberts et al. | |
| 5,307,865 | A * | 5/1994 | Inagaki et al. | 165/41 |
| 5,653,206 | A * | 8/1997 | Spurgin | 123/196 AB |
| 6,305,342 | B1 * | 10/2001 | Narita et al. | 123/196 R |
| 6,318,333 | B1 * | 11/2001 | Narita et al. | 123/196 R |
| 6,332,444 | B1 * | 12/2001 | Narita et al. | 123/196 R |
| 6,382,171 | B1 * | 5/2002 | Narita et al. | 123/196 R |
| 6,435,155 | B1 * | 8/2002 | Kawamoto | 123/196 A |
| 6,443,263 | B1 * | 9/2002 | Ito et al. | 184/6.5 |
| 6,470,847 | B1 * | 10/2002 | Kawamoto | 123/196 R |
| 6,540,047 | B1 * | 4/2003 | Yasui et al. | 184/104.2 |
| 2001/0015191 | A1 | 8/2001 | Kawamoto | |
| 2003/0111037 | A1 | 6/2003 | Takahashi | |

FOREIGN PATENT DOCUMENTS

| | | |
|---|---|---|
| EP | 0969185 A1 | 1/2000 |
| JP | 55112818 | 9/1980 |
| JP | 06193681 A | 7/1994 |
| JP | 08232626 A | 9/1996 |
| JP | 2000310286 | 11/2000 |
| JP | 2001227317 A | 8/2001 |
| JP | 2002201923 | 7/2002 |

* cited by examiner

*Primary Examiner*—Henry C. Yuen
*Assistant Examiner*—Jason Benton
(74) *Attorney, Agent, or Firm*—Carrier, Blackman & Associates, P.C.; William D. Blackman; Joseph P. Carrier

(57) ABSTRACT

A multi-cylinder internal combustion engine draws oil from an oil reservoir with an oil pump, and supplies oil to individual areas of the engine, after passing the oil through an oil filter and an oil cooler. A filter case containing an element of the oil filter is mounted to a side surface of the engine to facilitate the removal and replacement of the case. The oil cooler and a balancer are each respectively mounted to a front central portion of the internal combustion engine to enable oil cooling by an air-cooling effect of a running airflow, and to balance weight in the left-right direction of the internal combustion engine. Oil discharged from the oil cooler is introduced to a substantially central portion of the main gallery, to achieve uniformity of oil pressure supplied to individual bearing portions and uniformity of cooling of the individual bearing portions.

20 Claims, 7 Drawing Sheets

MULTI-CYLINDER INTERNAL COMBUSTION ENGINE AND VEHICLE INCORPORATING SAME

CROSS-REFERENCE TO RELATED APPLICATIONS

The present application claims priority under 35 USC 119, based on Japanese patent application No. 2002-374831, filed Dec. 25, 2002.

BACKGROUND OF THE INVENTION

1. Field of the Invention

The present invention relates to multi-cylinder internal combustion engines. More particularly, the present invention relates to an improved multi-cylinder combustion engine including an oil filter, an oil cooler, and a balancer, that provides improved serviceability, oil cooling, and evenly-distributed oil pressure.

2. Description of the Background Art

A number of different designs are known for multi-cylinder internal combustion engines. Many of the known engine designs include an oil filter, an oil cooler, and a balancer.

In a conventional multi-cylinder internal combustion engine, the oil filter is attached to a front surface of the internal combustion engine, with the axis of a cylindrical case thereof directed in the front-rear direction, together with an oil cooler (see, for example, Japanese Laid-open Patent No. 2001-227317 (FIGS. 2 and 5) & Japanese Laid-open Patent No. Hei 8-232626 (FIG. 6)). During replacement of the oil filter element in this arrangement, the case of the oil filter is attached and detached in the axial direction of the cylindrical case, namely, in the front-rear direction. In the known multi-cylinder internal combustion engine, however, since a number of exhaust pipes according to the number of cylinders are aligned at a front surface of the internal combustion engine, the oil filter case can be difficult to remove and replace, because of interference by the exhaust pipes.

There have been known engine designs in which an oil cooler is disposed at a substantially central portion in the left-right direction of a front surface of an internal combustion engine (see, for example, Japanese Patent Laid-open No. 2001-227317 (FIGS. 2 and 5) and Japanese Patent Laid-open No. Hei 8-232626 (FIG. 6)). In addition, there has also been a known engine design in which a balancer is disposed at a substantially central portion in the left-right direction of a front surface of an internal combustion engine (Japanese Patent Laid-open No. Hei 6-193681 (FIG. 2).

However, there has not been a known engine design in which both the oil cooler and the balancer are disposed, in close proximity to one another, at a substantially central portion of the front surface of the internal combustion engine.

Ordinarily, where either the oil cooler or the balancer is disposed at a central portion of the front surface of the internal combustion engine, the other is disposed at a rear or a lower portion of the internal combustion engine.

Although the known engine designs have utility for their intended purposes, a need still exists in the art for an improved design for a multi-cylinder combustion engine with an oil filter, an oil cooler, and a balancer. In particular, there is a need for an improved design for a multi-cylinder combustion engine with an oil filter, oil cooler, and a balancer that improves engine serviceability, and enhances oil cooling.

SUMMARY OF THE INVENTION

It is an object of the present invention to improve on the above-mentioned problems in the prior art, to improve the attaching position of an oil filter, and thereby to facilitate the removal and replacement of a filter case for replacement of an oil filter element.

It is another object of the present invention to improve the attaching position of an oil filter in relation to the position of the oil cooler, to enable oil cooling by an air-cooling effect of a running airflow, to improve the position of oil supply to a main gallery, and to thereby supply substantially uniform oil pressure to each bearing portion, and to effect substantially uniform cooling of each bearing portion.

It is a further object of the present invention to position an oil cooler and a balancer on an internal combustion engine so as to appropriately maintain a weight balance in the left-right direction of the engine.

The present invention provides an improved multi-cylinder internal combustion engine. In a first aspect of the invention, a multi-cylinder internal combustion engine, oil is drawn from an oil reservoir by an oil pump, and is supplied to individual portions of the engine after passing through an oil filter and oil cooler. In the first aspect hereof, the oil filter is attached to a side surface of the multi-cylinder internal combustion engine, while the oil cooler and a balancer are attached to a front central portion of the engine. The oil discharged from the oil cooler is introduced to a substantially central portion of a main gallery.

The engine according to the first aspect of the present invention is constituted as above, and an oil filter case containing a filter element therein is attached to a side surface of the engine's crankcase, so removal and replacement of the oil filter is easy to carry out.

In addition, even where the oil cooler, attached to a front surface of the internal combustion engine, is of the water cooling type, an air-cooling effect by a running airflow is obtained, resulting in a relatively high oil cooling efficiency.

Further, in the engine according to the first aspect hereof, since the oil is supplied to a substantially central portion of the main gallery, the oil is supplied to each bearing portion with a substantially uniform and stable pressure. In addition, since the oil cooled by the oil cooler is supplied to bearing portions, the bearing portions are also cooled uniformly.

Furthermore, the oil cooler is disposed at a front central portion of the internal combustion engine together with the balancer, it is possible to appropriately maintain a good weight balance in the left-right direction of the internal combustion engine.

In a multi-cylinder internal combustion engine according to a second aspect hereof, either one of a pair of crank webs belonging to a cylinder on the central side is provided with a drive gear, and the drive gear is meshed with a driven gear of the balancer, so as to thereby drive the balancer.

In the present invention constituted as above, a balancer driving mechanism can be made small to it will fit into a narrow space.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

Figure 1:
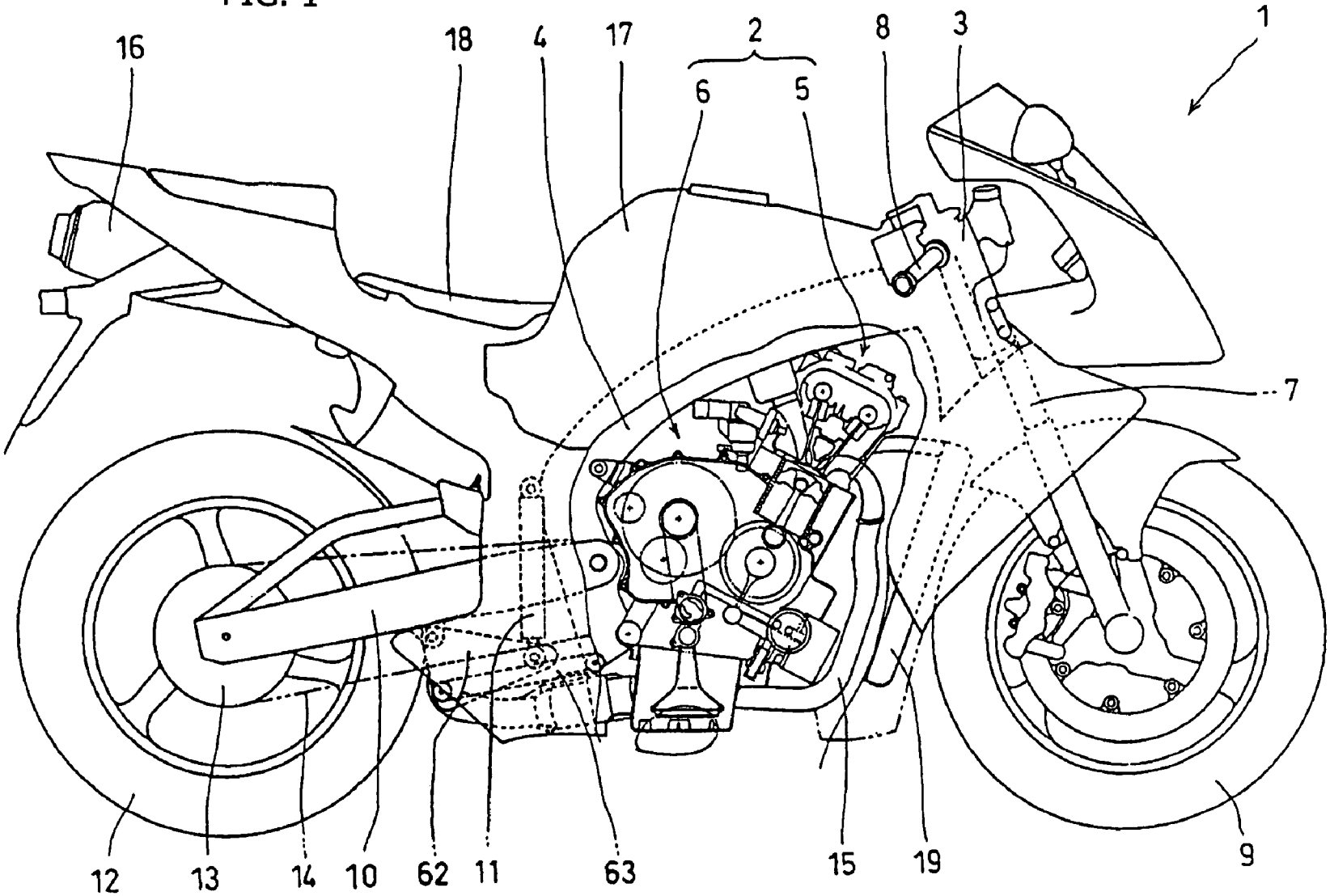
FIG. 1 is a side view, partially cut away, of a motorcycle including a water-cooled four-cylinder wet sump type internal combustion engine, according to an illustrative embodiment of the present invention.

FIG. 1 is a side view of a motorcycle 1, on which a water-cooled four-cylinder wet sump internal combustion engine 2 is mounted, according to one illustrative embodiment of the present invention. The figure is partly sectional. The engine 2 is adapted to be transversely mounted in a body frame 4, so that a longitudinal axis of the crankshaft thereof is oriented transverse to the longitudinal axis of the frame 4.

The internal combustion engine 2 includes a combustion apparatus unit 5 attached to a transmission unit 6. The internal combustion engine 2 is suspended from the vehicle body frame 4, and is connected to a head pipe 3 of the motorcycle 1. The vehicle body frame 4 is made up of a plurality of interconnected members.

A front fork 7 is turnably supported on the head pipe 3, a steering handle bar 8 is mounted to the upper end of the front fork 7, and a front wheel 9 is shaft-supported on the lower end of the front fork 7. The front end of a rear fork 10 is pivotally supported on a rear portion of the vehicle body frame 4, so that the rear fork 10 can be vertically oscillated. A triangular link member 62 is pivotally supported on a central lower portion of the rear fork 10 through one corner portion thereof, a rod-like link member 63 is pivotally supported on another corner portion of the triangular link member 62, and the other end of the rod-like link member 63 is pivotally supported on a lower portion of the vehicle body frame 4. A rear shock absorber 11 is interposed between the vehicle body frame 4 and the third corner portion of the triangular link member 62.

A rear wheel 12 is shaft-supported on the rear ends of the rear fork 10. The rear wheel 12 is driven by a chain 14, which is wrapped around a drive sprocket mounted to an end of a counter shaft in the transmission unit of the internal combustion engine 2 and a driven sprocket 13 mounted to the axle of the rear wheel. The counter shaft in the transmission unit is parallel to crankshafts and the like, and is disposed in the left-right direction of the vehicle body.

An exhaust pipe 15, in communication with exhaust ports on the front side of the internal combustion engine 2, extends around a lower lateral side of the engine to a rear portion of the vehicle body, and is connected to an exhaust muffler 16. A fuel tank 17 is mounted on an upper portion of the vehicle body frame 4, and a seat 18 is provided on the rear side thereof.

The internal combustion engine 2 is of the water-cooled type, and liquid coolant, which has been raised in temperature through the process of cooling cylinders and the oil, is cooled at a radiator 19.

Figure 2:
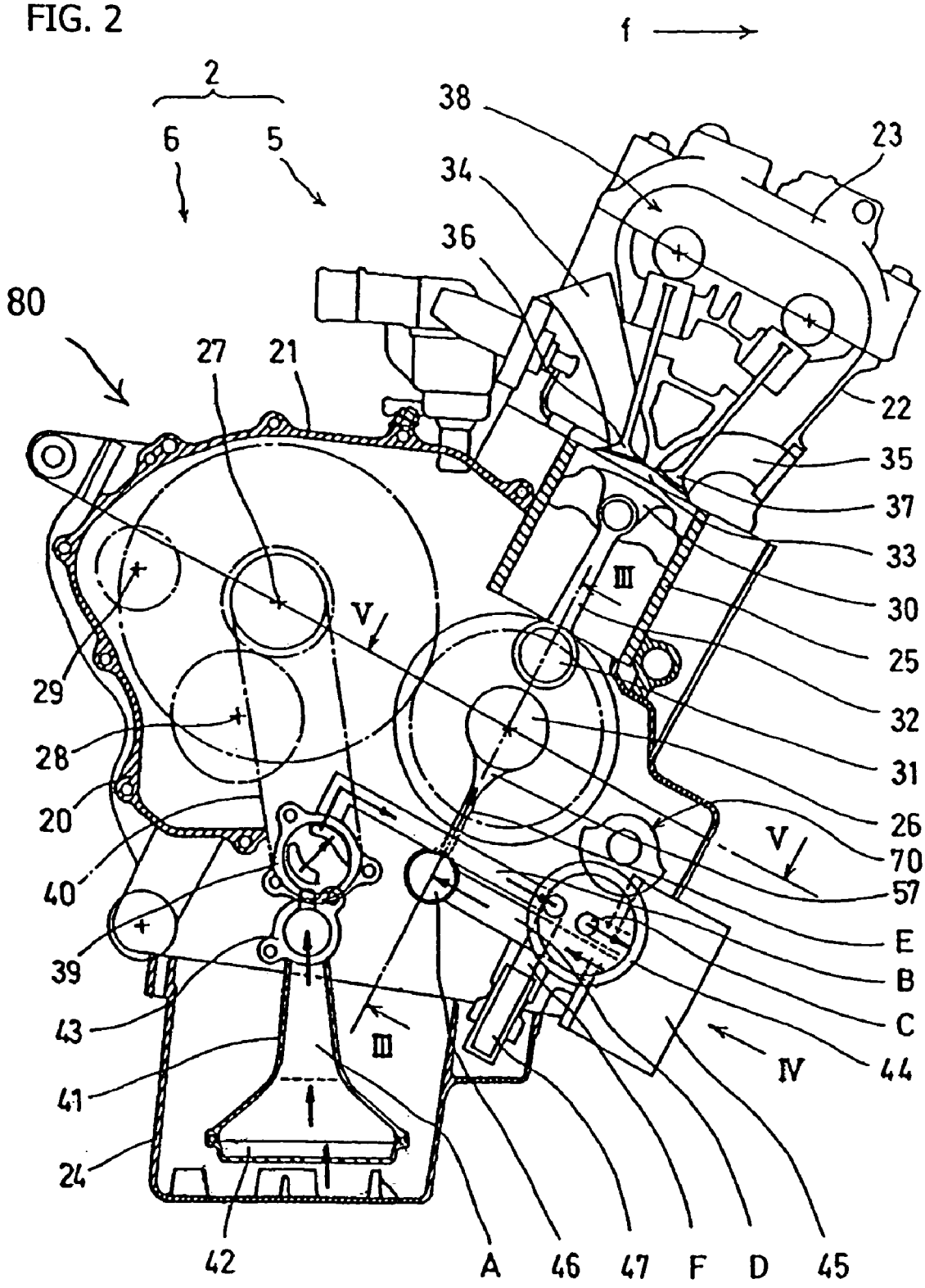
FIG. 2 is a vertical sectional view of the four-cylinder wet sump type internal combustion engine of FIG. 1.

FIG. 2 is a vertical sectional view of the water-cooled four-cylinder wet sump type internal combustion engine 2. The internal combustion engine 2 has the combustion apparatus unit 5 and the transmission unit 6 united with each other. Arrow f indicates the front (forward) side of the engine. An outer shell of the internal combustion engine 2 includes an engine block 80 including a lower crankcase 20 and an upper crankcase 21. The engine 2 also includes a cylinder head 22, a cylinder head cover 23, and an oil pan 24 disposed at a lower portion of the engine block 80. Each cylinder 25 is integral with the upper crankcase 21. Each crankshaft 26 and each main shaft 27 of the transmission are rotatably borne by bearings disposed between the lower crankcase 20 and the upper crankcase 21. The counter shaft 28 in the transmission is rotatably supported on the lower side of the main shaft 27, and a shift drum 29 is turnably supported on the rear side of the main shaft 27. Each piston 30 is slidably contained in each cylinder 25. A connecting rod 32 is connected between the piston 30 and a crank pin 31 of a crankshaft 26.

A combustion chamber 33 is provided in a portion of the engine 2 between an upper surface of the piston 30 and a lower portion of the cylinder head 22. Inner ends of an intake port 34 and an exhaust port 35 feed into the combustion chamber 33. Though not shown, an intake manifold, a carburetor, an air cleaner and the like are connected to the outer end of the intake port 34. The exhaust pipe 15 and the exhaust muffler 16 shown in FIG. 1 are connected to the outer end of the exhaust port 35. An intake valve 36 and an exhaust valve 37 are provided for opening and closing the intake port 34 and the exhaust port 35 so as to front on the combustion chamber 33. A valve-operating camshaft mechanism 38 is also provided inside an upper portion of the cylinder head 22 and the cylinder head cover 23.

An oil pump 39 is provided at a lower portion of the lower crankcase 20. The oil pump 39 is driven by a chain 40, wrapped around a drive sprocket on the main transmission shaft 27. A suction pipe 41 is provided which has its upper end connected to a suction port of the oil pump 39 and which extends while spreading in a flared horn shape toward the inside of the oil pan 24 on the lower side thereof. A strainer 42 is attached to a large diameter portion at the lower end of the suction pipe 41. Numeral 43 denotes an inspection window for checking the oil level. The inside of the strainer 42 and the suction pipe 41 constitutes an initial oil feed passage A extending upwardly from the oil pan 24.

An oil filter 44 is provided at a right side surface of the lower crankcase 20, and an oil cooler 45 is provided, near the oil filter, at a front surface of the lower crankcase 20. A balancer 70 is disposed near the oil cooler 45.

Figure 6:
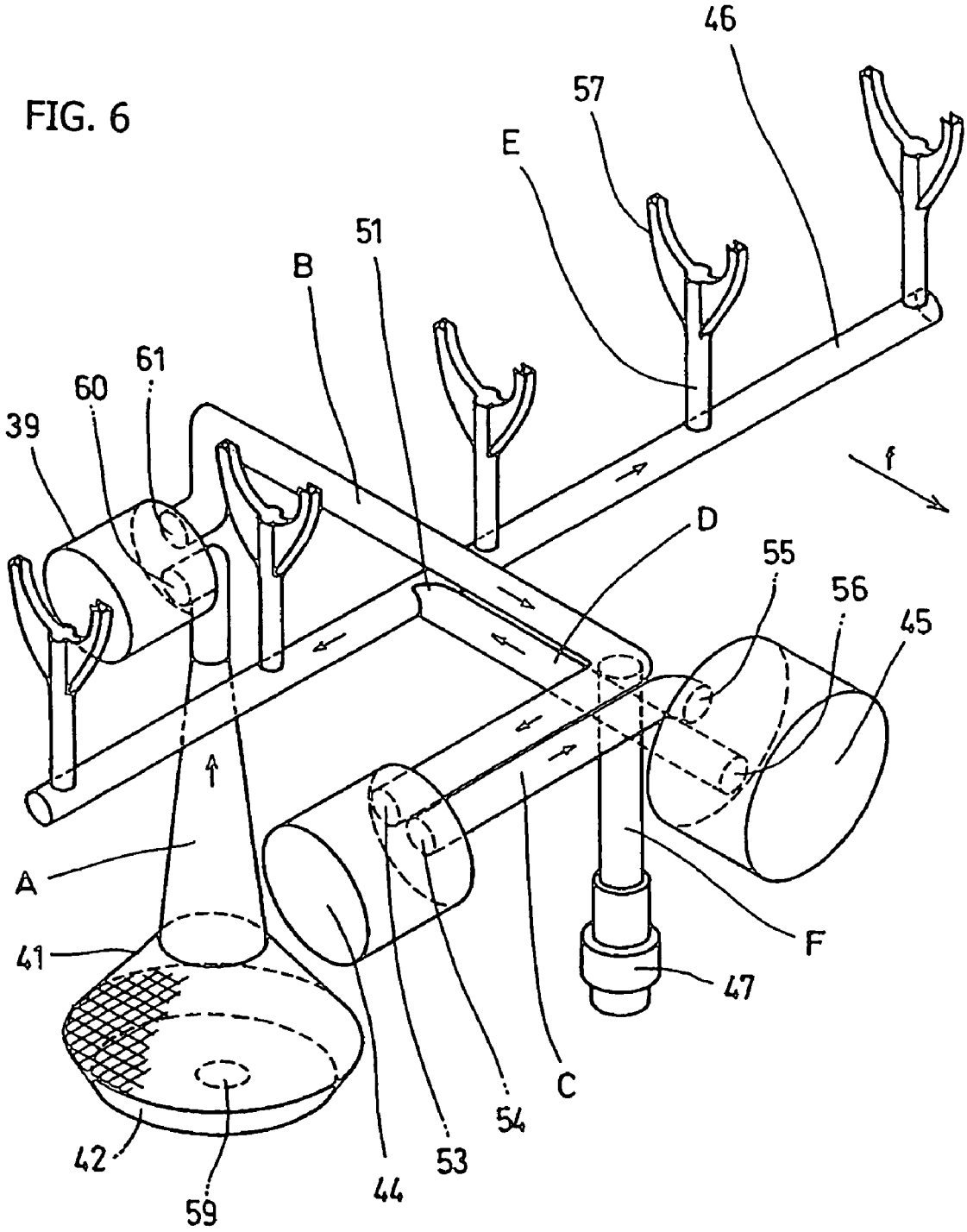
FIG. 6 is a simplified perspective view of an oil flow path through the engine of FIGS. 2–5, for facilitating understanding of the arrangement of oil passages therein.

As best seen in FIG. 6, a main gallery 46 is provided inside the lower crankcase 20, extending in the left-right direction of the engine. The oil, which has been pumped and pressurized by the oil pump 39, is fed through an oil passage B to the oil filter 44. The oil cleaned by the oil filter 44 is fed through an oil passage C to the oil cooler 45, where it is cooled. The oil thus cooled is fed through an oil supply passage D into a medial portion of the main gallery 46, as shown, from which it diverges in opposite directions and is fed to each bearing portion through a respective oil passage B, branching off the main gallery between the upper and lower crankcases 20 and 21, to be served for lubrication and cooling of rotary sliding portions of the crankshaft 26. Small arrows in the figure indicate the flow of the oil.

An oil passage F is branched off from the oil passage B, and a relief valve 47 is connected to the lower end of the oil passage F. When excessive pressure is generated in the system by the oil pump 39, the oil pressure is relieved by the relief valve 47.

Figure 3:
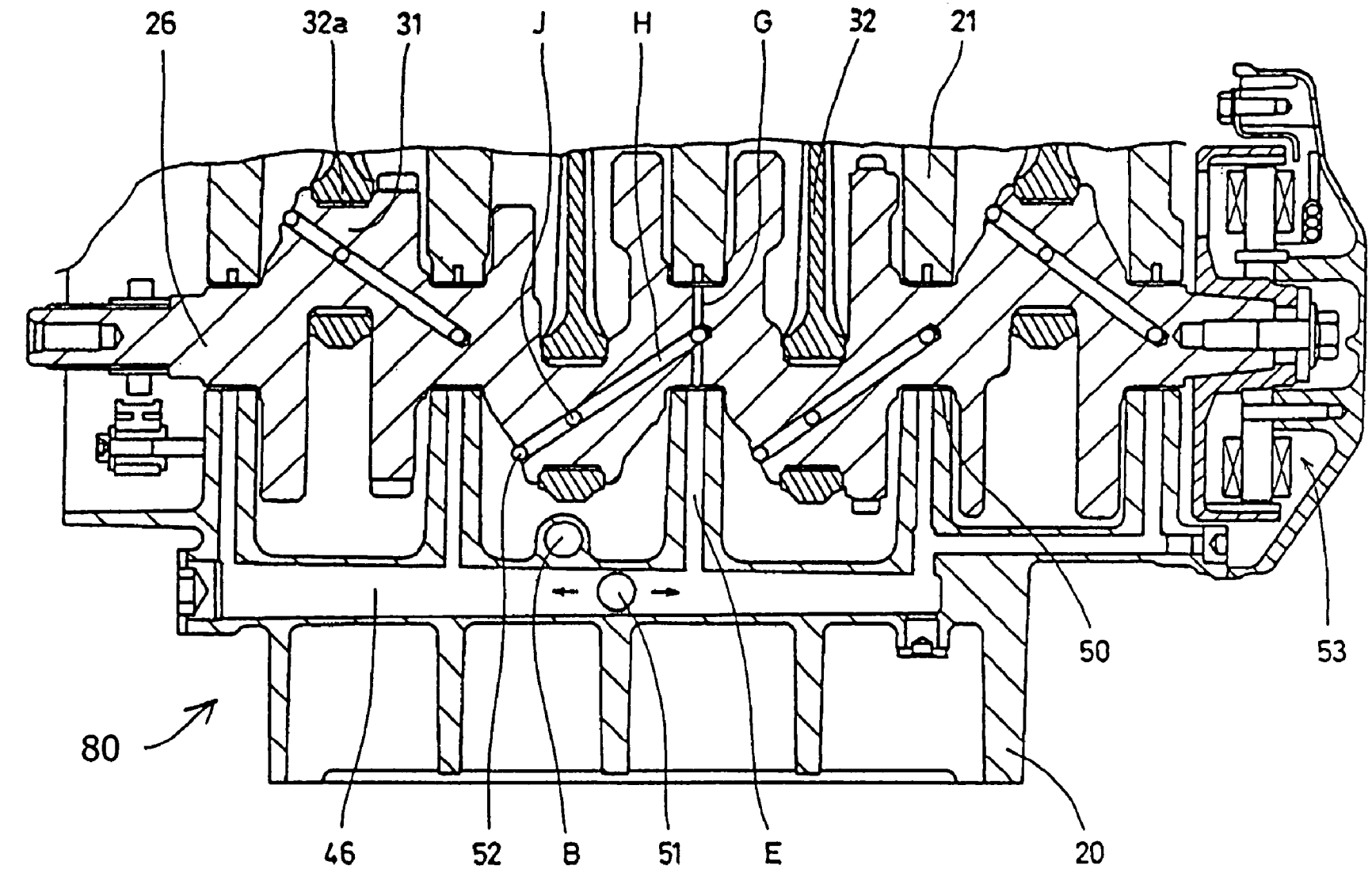
FIG. 3 is a sectional view, taken along line III—III of FIG. 2, and showing a cross section of a crankcase as viewed from the front side.

FIG. 3 is a sectional view taken along line III—III of FIG. 2, showing cross sections of the crankcases 20 and 21 as viewed from the front. The crankshaft 26, directed in the left-right direction of the engine, is disposed substantially at the center of the figure. The crankshaft 26 is provided with crank pins 31 at four locations, and large end portions 32*a* of connecting rods 32 connected to four pistons 30 (FIG. 2) are connected to the four crank pins 31, respectively. The crankshaft 26 is borne by bearing portions 50 formed at five locations by the lower crankcase 20 and the upper crankcase 21. In the lower crankcase 20, the main gallery 46 is bored in the left-right direction so as to pierce through partition wall-like portions. The cross section of the oil passage B (FIGS. 2 and 5) is seen, in contact with an upper portion of the main gallery 46. Numeral 51 denotes an oil inlet of the main gallery, through which the oil, fed from the oil cooler 45 through the oil passage D (FIGS. 2 and 5), flows into the main gallery 46. In the lower crankcase 20, oil passages E are bored so as to extend from the main gallery 46 to the individual bearing portions 50, respectively.

Oil passages G, orthogonal to the axial direction of the crankshaft 26, are bored at four locations of the portions supported by the individual bearing portions 50, of the crankshaft 26. A slant oil passage H communicated with the oil passage G is bored in each of the crank pins 31. Further, an oil passage J communicated with the oil passage H and crossing each crank pin 31 is bored. An opening end formed upon boring each of the oil passages H is plugged with a press-fitted steel ball 52. A generator 53 is mounted to an end of the crankshaft 26.

The oil, fed through the oil passage D and fed into the main gallery 46 through the oil inlet 51, flows to the individual bearing portions 50 through the upward oil passages E, to lubricate the sliding portions of the crankshaft 26. Further, the oil is fed through the oil passages G, the oil passages H, and the oil passages J to be pushed out into the space between the crank pins 31 and the large end portions 32*a* of the connecting rods 32, thereby lubricating the sliding portions there.

Figure 4:
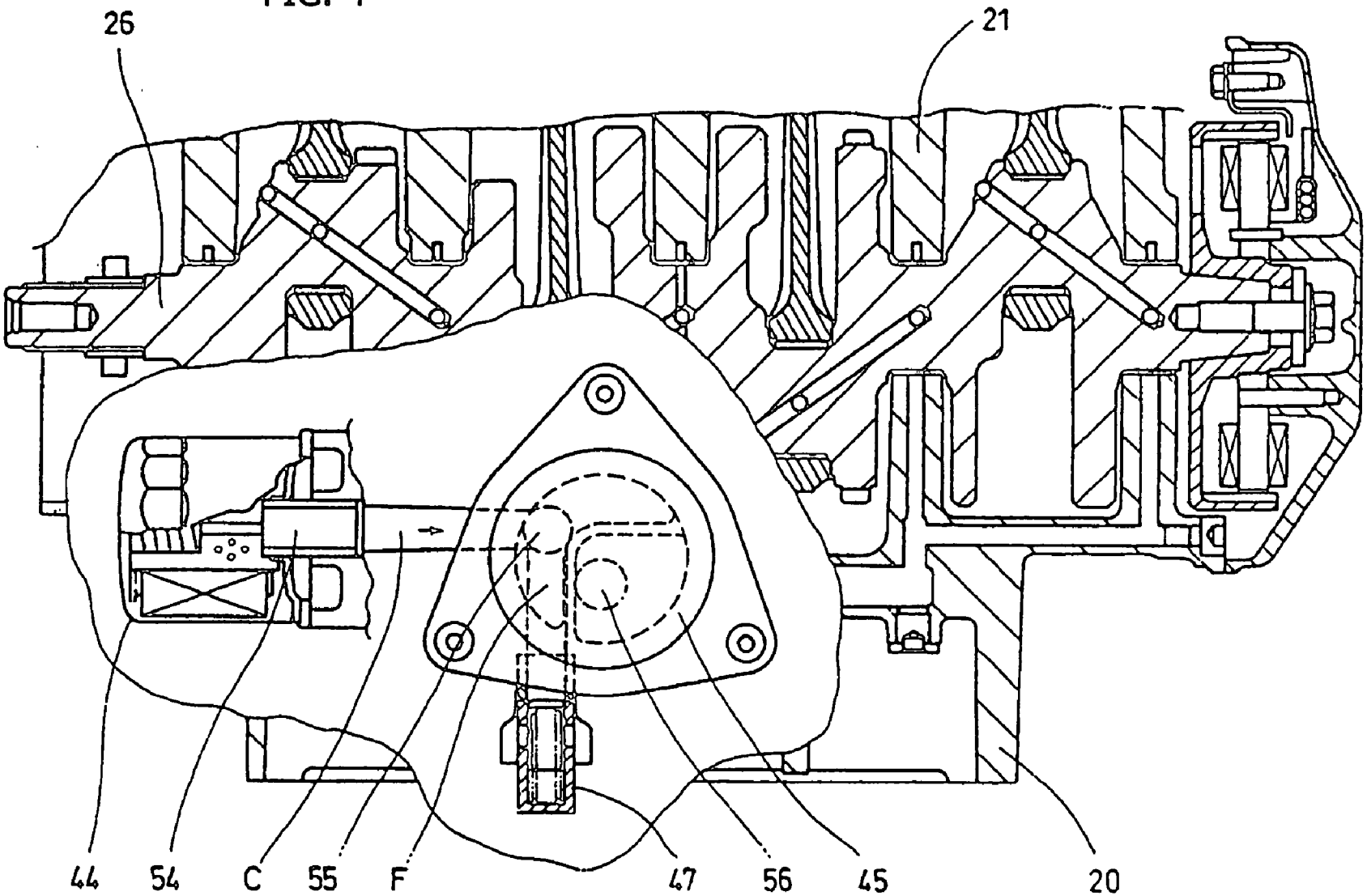
FIG. 4 is a view of an oil filter, an oil cooler, and the related oil passages as viewed in the direction of arrow IV of FIG. 2, presented at a corresponding position of FIG. 3.

FIG. 4 is a view of the oil filter 44, the oil cooler 45, and the related oil passages as viewed along arrow IV of FIG. 2, presented at a corresponding position of FIG. 3. In the figure, symbol 44 denotes the oil filter, and 45 the oil cooler. An oil outlet 54 of the oil filter 41 and an oil inlet 55 of the oil cooler 45 are connected to each other by an oil passage C bored in the lower crankcase 21. An oil outlet 56 of the oil cooler 45 and the oil inlet 51 of the main gallery 46 shown in FIG. 3 are connected to each other by the rectilinear oil passage D (FIGS. 2 and 5) bored in the lower crankcase 21. The oil passage F is an oil passage branched from the oil passage B (the oil passage communicated to the oil inlet 53 of the oil filter 44 shown in FIG. 5) which is not shown, and the relief valve 47 is connected to the lower end of the oil passage F. The relief valve 47 releases excessive pressure, if any, generated by the oil pump 39.

Figure 5:
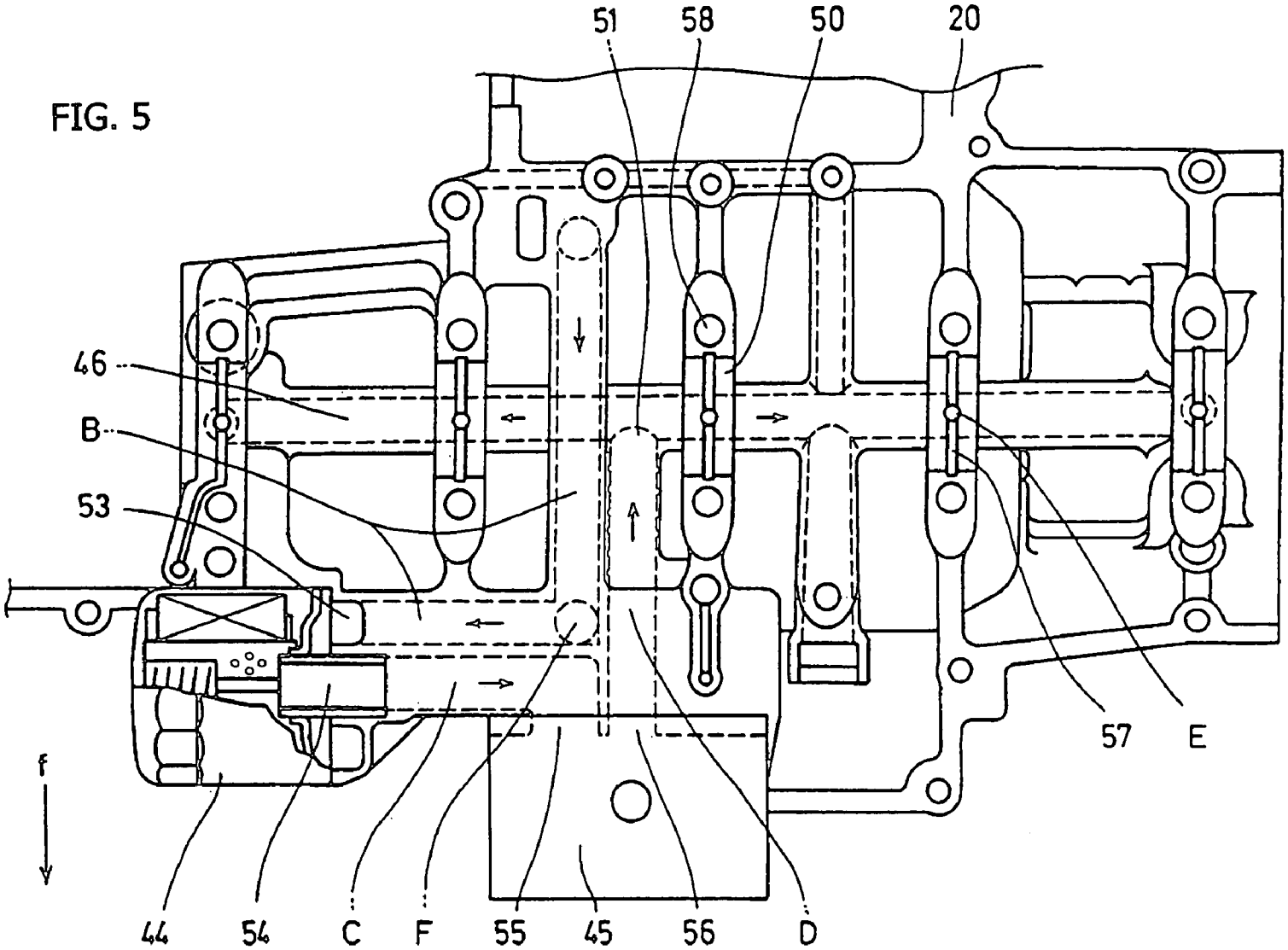
FIG. 5 is a view of a lower crankcase as viewed in the direction of arrow V—V of FIG. 2.

FIG. 5 is a view of the lower crankcase 20 as viewed along arrows V—V of FIG. 2, and arrow f indicates the front (forward) direction. Small arrows in the figure indicate the flow of the oil. The oil filter 44 is mounted to a right side portion of the lower crankcase 20. The oil cooler 45 is mounted to a front portion of the lower crankcase 20 on the front side of a cylinder on the central side of a total of four cylinders. The main gallery 46 is provided to pierce through the lower crankcase in the left-right direction on the lower side of the crankshaft. The oil passage B crossing the main gallery on the upper side of the main gallery and communicated to the oil inlet 53 of the oil filter 44 is seen. In addition, the section of the oil passage F branched downwards from a bent portion of the oil passage B is seen. The oil outlet 54 of the oil filter 44 and the oil inlet 55 of the oil cooler 45 are connected to each other by the oil passage C. The oil outlet 56 of the oil cooler 45 and the oil inlet 51 of the main gallery are connected to each other by the oil passage D. In the figure, the bearing portions 50 provided at five locations in an upper surface of the lower crankcase 20 are seen, and the oil passages E communicated with the main gallery 46 are opened in the centers of the individual bearing portions 50. Slits 57 are formed on both sides of each of the oil passages E. The side shape of each of the oil passages E is shown also in FIG. 2. Numeral 58 denotes boltholes for connecting the bearing portions of the upper and lower crankcases in an annular form.

The oil fed under pressure by the oil pump and fed through the oil passage B into the oil filter 44 is cleaned there, before being fed through the oil passage C into the oil cooler 45. After being cooled by water in the oil cooler 45, the oil is fed through the oil passage D into the main gallery 46, and is supplied through the oil passages E to the individual bearing portions 50, to be served for lubrication. Water raised in temperature through the process of cooling the oil is cooled in the radiator 19 (FIG. 1) mounted to the front surface of the vehicle body. In this internal combustion engine, the oil cooler itself is also mounted to the front surface of the internal combustion engine, so that an effect of air-cooling the oil is obtained.

FIG. 6 is a perspective view for easy understanding of connections of the oil passages in the above embodiment. In the oil circulation system shown in the figure, the oil sucked through an oil inlet 59 of the strainer 42 is fed through the oil passage A in the oil suction pipe 41, and flows into the oil pump 39 through an oil inlet 60. The oil raised in pressure by the oil pump 39 exits through an oil outlet 61, is fed through the oil passage B, and flows into the oil filter 44 through the oil inlet 53. The oil cleaned by the oil filter 44 goes out through the oil outlet 54, is fed through the oil passage C, and flows into the oil cooler 45 through the oil inlet 55. The oil cooled in the oil cooler 45 goes out through the oil outlet 56, is fed through the oil passage D, and flows into the main gallery 46 through the oil inlet 51. The oil injected into a substantially central portion of the laterally elongated main gallery 46 is delivered substantially uniformly into the five oil passages, to be supplied to the individual bearing portions 50 through the oil passages E and the slits 57. When an excessive pressure is generated in the oil by the oil pump 39, the excessive pressure is released by the relief valve 47 connected to the lower end of the oil passage F branched from the oil passage B. The oil thus released returns to the oil pan. The oil passages B to F are oil passages bored in the crankcase.

Figure 7:
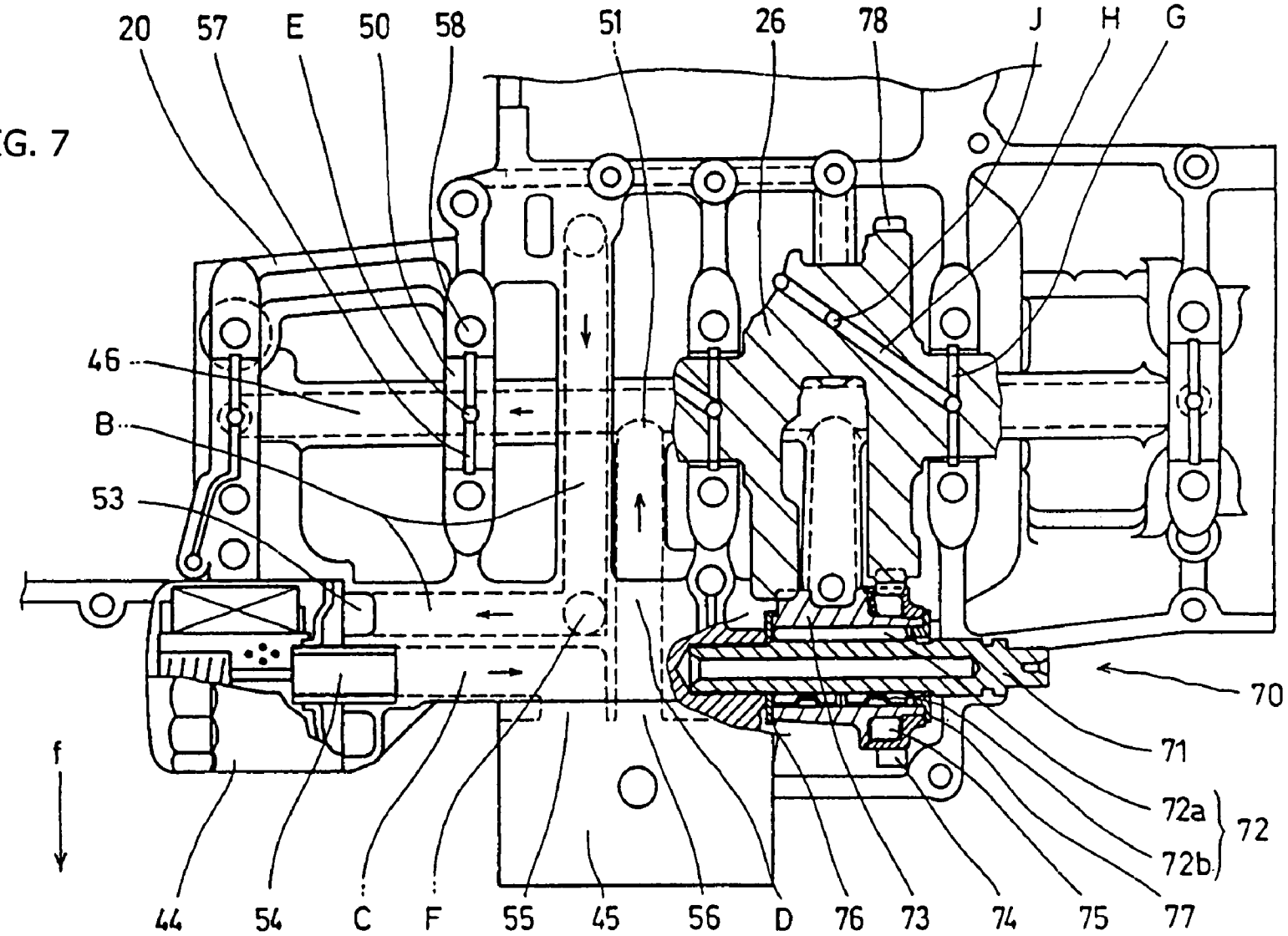
FIG. 7 is a cross-sectional view of a part of a crankshaft and a balancer as viewed in the direction of arrow V—V of FIG. 2, shown overlapping with a corresponding position of the lower crankcase 20 of FIG. 5.

FIG. 7 is a cross-sectional view of a part of the crankshaft 26 and the balancer 70 as viewed in the direction of arrow V—V of FIG. 2, shown overlapping with the corresponding position of the lower crankcase of FIG. 5. In the figure, the crankcase 26 and the balancer 70 are shown in section.

As shown in FIG. 7, in the depicted embodiment of the engine 2, the balancer 70 is positioned at the front part of the engine block in front of an intermediate cylinder, of a total of four cylinders. The balancer 70 is provided to smooth out operation of the engine 2, and includes a balancer support shaft 71 and a weight 73 mounted on the shaft. The balancer support shaft 71 is supported and non-rotatably fixed onto an interior wall body portion of the lower crankcase 20.

The balance weight 73 is rotatably held on the outer circumference of the balancer support shaft 71 through needle bearings 72, including needles 72*a* and needle holders 72*b*. A balancer driven gear 74 is fitted on the outer circumference of a boss portion of the balance weight 73, adjacently to a weight portion, and a recess-projection fitting portion 75 ensures that the balance weight 73 and the balancer driven gear 74 are rotated together as one body. Both ends of the balance weight 73 are restricted in axial movement by side washers 76 and 77, together with the balancer driven shaft 74.

One of the crank webs of the crankshaft 26 is provided with a balancer drive gear 78, which is meshed with the balancer driven shaft 74 so as to drive the balancer 70 to rotate at a rotational speed of double the rotational speed of the crankshaft, for canceling secondary vibration.

In this embodiment, the oil cooler 45 is mounted on the front side of an intermediate cylinder, out of a total of four cylinders. In addition, the balancer 70 is positioned on the front side of another intermediate cylinder, of a total of four cylinders. Since the oil cooler and the balancer are thus disposed, next to one another, at a front central portion of the internal combustion engine, it is possible to appropriately maintain a weight balance in the left-right direction of the internal combustion engine. While the oil cooler and the balancer are shown aligned side by side in the left-right direction, as viewed from above as in FIG. 7, alternatively, both of them can be located at the center of the internal combustion engine, while being sufficiently spaced from each other in the vertical direction. With this arrangement, both of them are seen in an overlapping state when viewed from above.

The multi-cylinder internal combustion engine according to the present invention is constituted as described, functions as described, and has the following effects:

(1) The case containing the element of the oil filter is mounted to a side surface of the engine block. Therefore, the removal and replacement of the filter case for replacement of the element can be easily performed, without interference from the four exhaust pipes arranged on the front surface of the internal combustion engine.

(2) While the oil cooler mounted on the front surface of the engine is of the water-cooled type, it receives a running airflow directly thereon during movement of the vehicle, so that an air-cooling effect by the running airflow is also obtained, with the result of a high oil cooling efficiency.

(3) The oil is supplied to a substantially central portion of the main gallery, which extends in the left-right direction, and the oil pressure supplied to individual bearing portions, dispersively arranged in the left-right direction, is made uniform and stable. Since the oil cooled by the oil cooler is supplied uniformly to the individual bearing portions, the bearing portions are cooled uniformly.

(4) It is possible to appropriately maintain a weight balance in the left-right direction of the internal combustion engine since the oil cooler and the balancer are both disposed at a front central portion of the internal combustion engine.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, are within the scope of the claims, are intended to be within the scope and spirit of the present invention.

Having thus, described the invention, what is claimed is:

1. A multi-cylinder internal combustion engine, comprising an engine block having a plurality of oil galleries formed therein, an oil filter and an oil cooler operatively attached to the engine block, and a balancer rotatably disposed within said engine block;

wherein said oil filter is attached to a side surface of said engine block;

wherein said oil cooler and said balancer are each respectively attached to a front central portion of said multi-cylinder internal combustion engine;

said engine further comprising an oil pan having an oil reservoir portion formed therein for temporarily storing engine oil, and an oil pump for drawing oil from the oil reservoir portion of the oil pan and for supplying the oil to individual portions of the internal combustion engine after passing the oil through the oil filter and the oil cooler;

wherein said engine block is configured with a main oil gallery and an oil supply passage formed therein, said oil supply passage extending from an area proximate the oil cooler to a medial portion of the main oil gallery, so that oil from said oil cooler is introduced via the oil supply passage to a substantially central part of the main oil gallery formed in said engine block.

2. A multi-cylinder internal combustion engine as set forth in claim 1, further comprising a crankshaft having a plurality of crankshaft webs, wherein said balancer comprises a driven gear and wherein an intermediate crankshaft web of said crankshaft is provided with a drive gear thereon; and wherein said drive gear on said crankshaft is meshed with the driven gear of said balancer so as to thereby drive said balancer.

3. A multi-cylinder internal combustion engine as set forth in claim 1, wherein said oil filter can be detached from said engine without interference from components of said engine.

4. A multi-cylinder internal combustion engine as set forth in claim 1, wherein said oil cooler improves oil flow throughout said engine so that oil pressure is uniform.

5. A multi-cylinder internal combustion engine as set forth in claim 1, wherein said oil filter comprises an oil filter case and an oil filter element.

6. A multi-cylinder internal combustion engine as set forth in claim 1, wherein said oil cooler and said balancer are so situated throughout said engine so as to maintain a weight balance from left to right.

7. A multi-cylinder internal combustion engine as set forth in claim 1, wherein said oil cooler is utilized with a water-cooled version of said engine, and wherein an additional cooling effect is achieved by running airflow over said oil cooler when said engine is moving through space.

8. A multi-cylinder internal combustion engine, comprising an engine block having a plurality of oil galleries formed therein, an oil filter and an oil cooler operatively attached to the engine block, and a balancer rotatably disposed within said engine block:

wherein said oil filter is attached to a side surface of said engine block;

wherein said oil cooler and said balancer are each respectively attached to a front central portion of said multi-cylinder internal combustion engine;

and wherein said engine further comprises a crankshaft comprising webs, and bearings surrounding selected portions of said crankshaft, an oil pan, and an oil pump for drawing oil from an oil reservoir portion of the oil pan and for supplying the oil to individual portions of the internal combustion engine after passing the oil trough the oil filter and the oil cooler;

wherein said engine is configured so that oil from said oil cooler is introduced to a substantially central part of a main oil gallery formed in said engine block;

and wherein during engine operation, said oil cooler supplies oil, which is of uniform pressure and has a cooling effect, to said bearings of said engine.

9. A multi-cylinder internal combustion engine as set forth in claim 8, wherein said balancer is powered by g driving mechanism which is narrower than one of said crankshaft webs.

10. A multi-cylinder internal combustion engine as set forth in claim 1, wherein said oil filter case is easily removable for ease of maintenance.

11. A multi-cylinder internal combustion engine as set forth in claim 1, wherein said balancer is located near the gear drive assembly unit.

12. A multi-cylinder internal combustion engine as set forth in claim 1, wherein said oil cooler is disposed at the front of said engine, so that said oil cooler is receptive of moving airflow.

13. A multi-cylinder internal combustion engine as set forth in claim 1, wherein said oil cooler is disposed centrally along said engine, so as to distribute oil evenly to said engine internal components.

14. A multi-cylinder internal combustion engine adapted to be transversely mounted in a vehicle frame, said engine comprising an engine block having a front surface and having a plurality of oil galleries formed therein;

a crankshaft disposed in the engine block and having a longitudinal axis which is substantially parallel to the front surface of the engine block;

an oil cooler attached to the front surface of the engine block; and a balancer rotatably disposed in the engine block and comprising a balance weight;

wherein the oil cooler and the balancer are respectively disposed proximate a substantially central portion of the front surface of the engine block.

15. A multi-cylinder internal combustion engine adapted to be transversely mounted in a vehicle frame, said engine comprising:

an engine block having a front surface and having a plurality of oil galleries formed therein;

a crankshaft disposed in the engine block and having a longitudinal axis which is substantially parallel to the front surface of the engine block;

an oil cooler attached to the front surface of the engine block;

an oil filter situated proximate the oil cooler and oriented substantially orthogonal thereto; and a balancer rotatably disposed in the engine block and comprising a balance weight;

wherein the oil cooler and the balancer are respectively disposed proximate a substantially central portion of the front surface of the engine block.

16. The internal combustion engine of claim 14, wherein the crankshaft has an integral balancer drive gear hereon, and the balancer comprises a driven gear which is enmeshed with said balancer drive gear.

17. The internal combustion engine of claim 14, wherein said engine comprises a balancer support shaft which is supported and non-rotatably fixed onto an interior wall of the engine block, and wherein said balancer is rotatably mounted on said balancer support shaft.

18. The internal combustion engine of claim 14, wherein the oil cooler is mounted on the front side of an intermediate cylinder, and wherein the balancer is positioned on the front side of another intermediate cylinder.

19. The internal combustion engine of claim 14, wherein said engine is configured so that oil from said oil cooler is introduced to a substantially central part of a main oil gallery formed in said engine block.

20. A motorcycle, comprising:

a frame, and an internal combustion engine mounted transversely in said frame, wherein the internal combustion engine is the engine of claim 14.

* * * * *